US007073234B2

(12) United States Patent
Turpin

(10) Patent No.: US 7,073,234 B2
(45) Date of Patent: Jul. 11, 2006

(54) QUICK-RELEASE BUCKLE

(75) Inventor: Jason Turpin, San Francisco, CA (US)

(73) Assignee: Aqua Lung America, Inc., Vista, CA (US)

( * ) Notice: Subject to any disclaimer, the term of this patent is extended or adjusted under 35 U.S.C. 154(b) by 471 days.

(21) Appl. No.: 10/077,501

(22) Filed: Feb. 14, 2002

(65) Prior Publication Data

US 2003/0150088 A1 Aug. 14, 2003

(51) Int. Cl.
*A44B 11/25* (2006.01)
*A44B 17/00* (2006.01)

(52) U.S. Cl. ..... 24/579.09; 24/572.1; 24/573.09; 24/606; 24/616; 24/664

(58) Field of Classification Search ..... 24/579.09, 24/573.09, 572.1, 606, 664, 616, 647, 631 K, 24/3.4, 597; 119/14.1, 865
See application file for complete search history.

(56) References Cited

U.S. PATENT DOCUMENTS 1,091,449 A * 3/1914 Westin ..... 24/606
2,522,790 A * 9/1950 Johnston ..... 24/647
3,200,463 A * 8/1965 Craven et al. ..... 24/645
4,831,694 A * 5/1989 Kong ..... 24/625
4,924,562 A * 5/1990 Pogharian ..... 24/647
5,222,279 A * 6/1993 Frano et al. ..... 24/625
5,440,792 A * 8/1995 Ida ..... 24/615
5,465,472 A * 11/1995 Matoba ..... 24/625
5,832,573 A * 11/1998 Howell ..... 24/664
6,076,237 A * 6/2000 Goorhouse ..... 24/200
6,145,172 A * 11/2000 Bourdon ..... 24/625
6,154,936 A * 12/2000 Howell et al. ..... 24/625
6,487,761 B1 * 12/2002 Van Tassel ..... 24/606

* cited by examiner

*Primary Examiner*—Jack Lavinder
(74) *Attorney, Agent, or Firm*—Randolf O. Siegesmund; Gordon & Rees, LLP

(57) ABSTRACT

A quick release buckle including a female buckle member, including attachment device, having a pocket formed therein accessible through a rear opening formed in the female buckle member and including a first cover having a slot formed therein, a male buckle member arranged for complimentary sliding assembly with the female buckle member through the rear opening, the male buckle member including a leaf spring for insertion into the pocket of the female buckle member, the leaf spring including a clasp for snap locking engagement in the slot when the buckle members are fully assembled, a handle member, slidably assembled with the male buckle member and insertable therewith into the pocket in the female buckle member, the handle member including an independently moveable release device located adjacent the clasp, when all the members are fully assembled, connected to handle extending away from the buckle, the independently moveable release means adapted to move against the clasp during rapid pulling motion of the handle to rapidly pry the clasp from locking engagement in the slot and release the female buckle member and the male buckle member for immediate parting.

25 Claims, 7 Drawing Sheets

QUICK-RELEASE BUCKLE

BACKGROUND OF THE INVENTION

1. Field of the Invention

This invention pertains to the field of buckles. More particularly, the invention pertains to buckles known in the trade as "quick-release" buckles and is particularly designed for use in underwater operations as a buckle on swimming and diving gear.

2. Description of the Prior Art

Buckles are often used to hold the ends of belts, straps, bands and other such linear elements together. They are also used to hold removeable devices to a garment such as a weight flap to an underwater diver's suit. Buckles come in a variety of designs and have diverse characteristics such as being adjustable, quick-closing, and quick-opening. In the area of quick-opening or quick-release buckles, Hook and loop fasteners is quite popular because they contain no metal, are generally immune to harsh treatment, and are resistant to most elements such as wind, rain, snow and the like.

However, in the specific field of underwater activity, Hook and loop fasteners have lost favor as an attachment or buckle material primarily because they are easily contaminated by slimy underwater plants and mucous-exuding fish. Once contaminated, the hook and loop fastener's surfaces are difficult to clean and often become smelly and slippery to the touch and thus no longer usable as inter-attachment surfaces.

Quick-release buckles are a significant necessity in underwater activities. Failure of the breathing apparatus, the air tank becoming empty, and entanglement in underwater plants and structures may necessitate quick release of diver's weight belts, control lines, and suit accessories so that the diver may rid himself or herself of the entanglement and speed to the surface so as not to die of asphyxiation or otherwise drown. While underwater, weight belts and accessories must be maintained in positive connection with the diver so that other emergencies, such as loss of ballast weight or loss of safety accessories do not occur. Accordingly, underwater buckles must give positive connection and quick release as well as being quite resistant to malfunction and adversely affected by underwater elements.

At present, the prior art uses buckles that require more than one maneuver before coming loose. In most cases, the buckle requires first, locating the buckle on the underwater diving gear, then pulling the buckle or a strap hanging from the buckle in one direction, then pulling the buckle or another strap hanging from the buckle in another direction to achieve separation of the buckle components.

SUMMARY OF THE INVENTION

This invention is a quick-release, on maneuver, buckle that satisfies the problems with hook and loop fasteners and other buckles of the prior art. It is extremely positive in achieving and thereafter maintaining a connection to whatever it is buckling together. It is made entirely of plastic, or fiber-reinforced plastic, and has smooth surfaces so that it is very resistant to deterioration and malfunction. In addition, the parts making up the novel buckle are not subject to excessive movement, when the buckle is closed and/or when the buckle is opened. This lack of excessive movement means that underwater adverse conditions will not affect the movement of the buckle parts. Finally, and probably most importantly, it is able to be disconnected with a single, sharp pull of a handle, provided as part of the buckle, and thus operates quickly and positively in emergency situations.

The invention herein is a quick release buckle comprising a female buckle member having a pocket formed therein accessible through a rear opening and includes a first over having a slot formed therein, a male buckle member arranged for complimentary sliding assembly with the female buckle member, the male buckle member including a leaf spring for insertion into the pocket and including a clasp for locking snap engagement in a slot formed in the female member. A handle member is slidably assembled with the male buckle member including an independently moveable release means connected to a handle portion extending away from the buckle where the release means moves against the clasp, during a single, rapid pulling motion of the handle portion, to rapidly pry the clasp from locking snap engagement in the slot to release the buckle.

Accordingly, the main object of this invention is a buckle that is extremely positive in achieving and thereafter maintaining a tight connection to whatever it is buckling together. Other objects of the invention include a buckle that is made entirely of plastic so that it is very resistant to deterioration and malfunction; a buckle having its parts not subject to excessive movement, when the buckle is closed and/or when the buckle is opened, so that underwater adverse conditions will not affect the movement of the buckle parts; and a buckle that is able to be disconnected with a single, sharp pull of a handle, provided as part of the buckle, to function well in emergency situations.

These and other objects of the invention will become more clear when one reads the following specification, taken together with the drawings that are attached hereto. The scope of protection sought by the inventor may be gleaned from a fair reading of the Claims that conclude this specification.

DESCRIPTION OF THE DRAWINGS

FIG. 4 is a bottom-perspective view, except for the handle and handle strap, of the disassembled three pieces making up the quick-release buckle of this invention;

DESCRIPTION OF THE PREFERRED EMBODIMENT

Figures 1A, 1B, 1C, 1D:
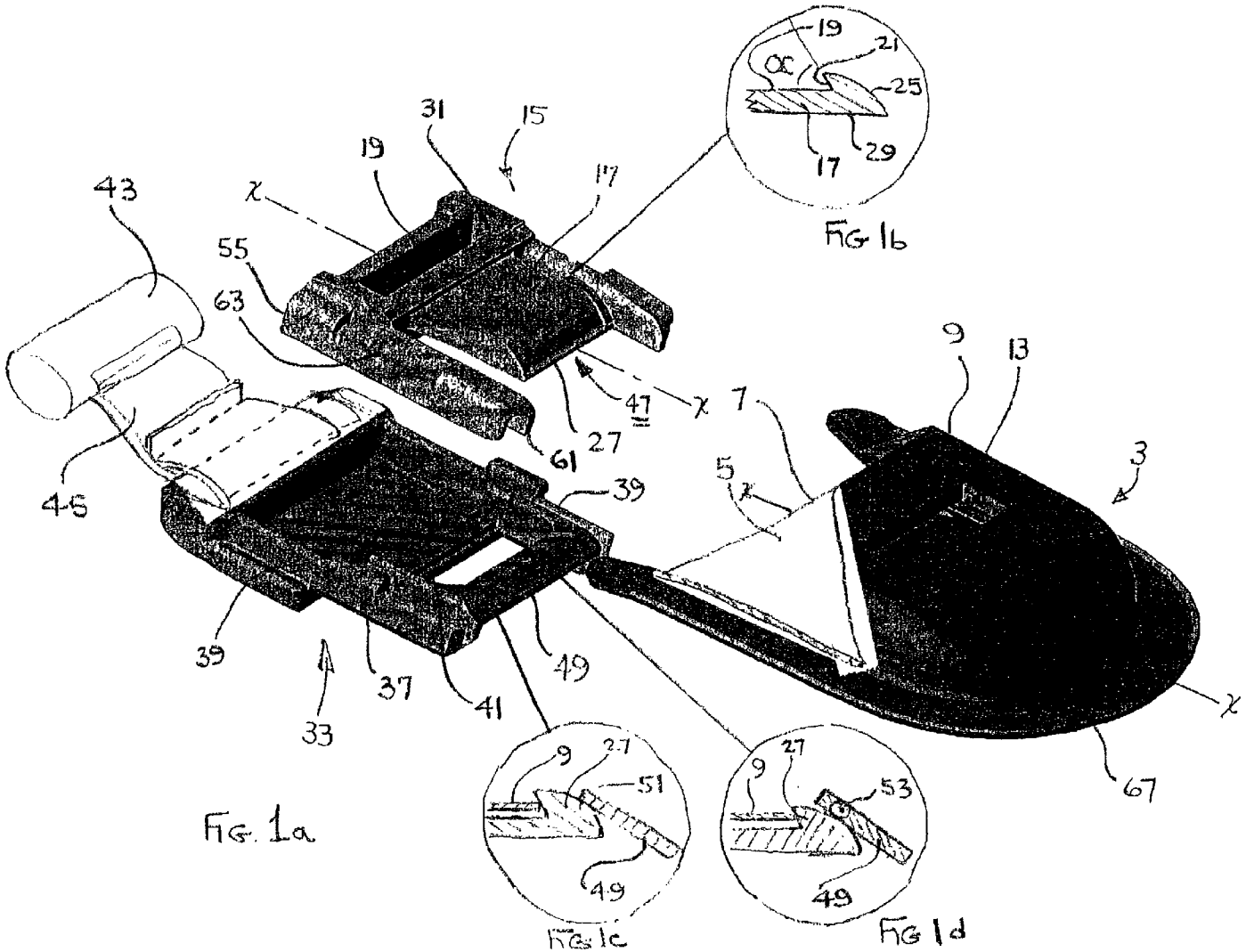
FIG. 1*a* is a top-perspective view of the disassembled three pieces making up the quick-release buckle of this invention.
FIG. 1*b* is a sectional side view, taken along lines x—x in FIG. 1*a*, showing the clasp formed on the end of the tongue.
FIG. 1*c* is a sectional side view, taken along lines x—x in FIG. 1*a*, showing one embodiment of the release surface and how it mates with the clasp.
FIG. 1*d* is another sectional side view, taken along lines x—x in FIG. 1*a*, showing another embodiment of the release surface and how it mates with the clasp.
Figure 2:
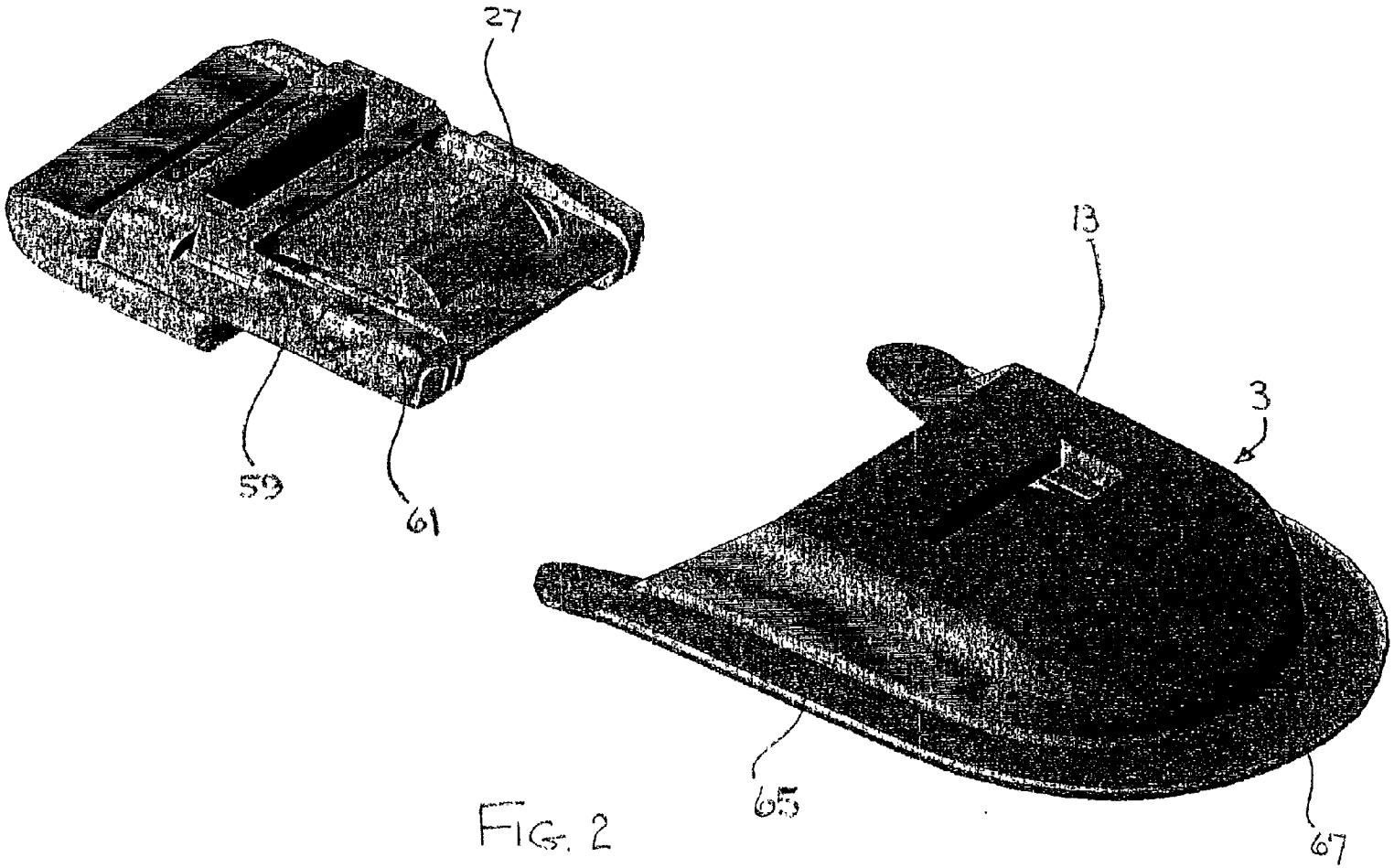
FIG. 2 is a top-perspective view of the same three pieces shown in FIG. 1, except for the handle and handle strap, showing the male buckle member to be assembled with the handle member.
Figure 3:
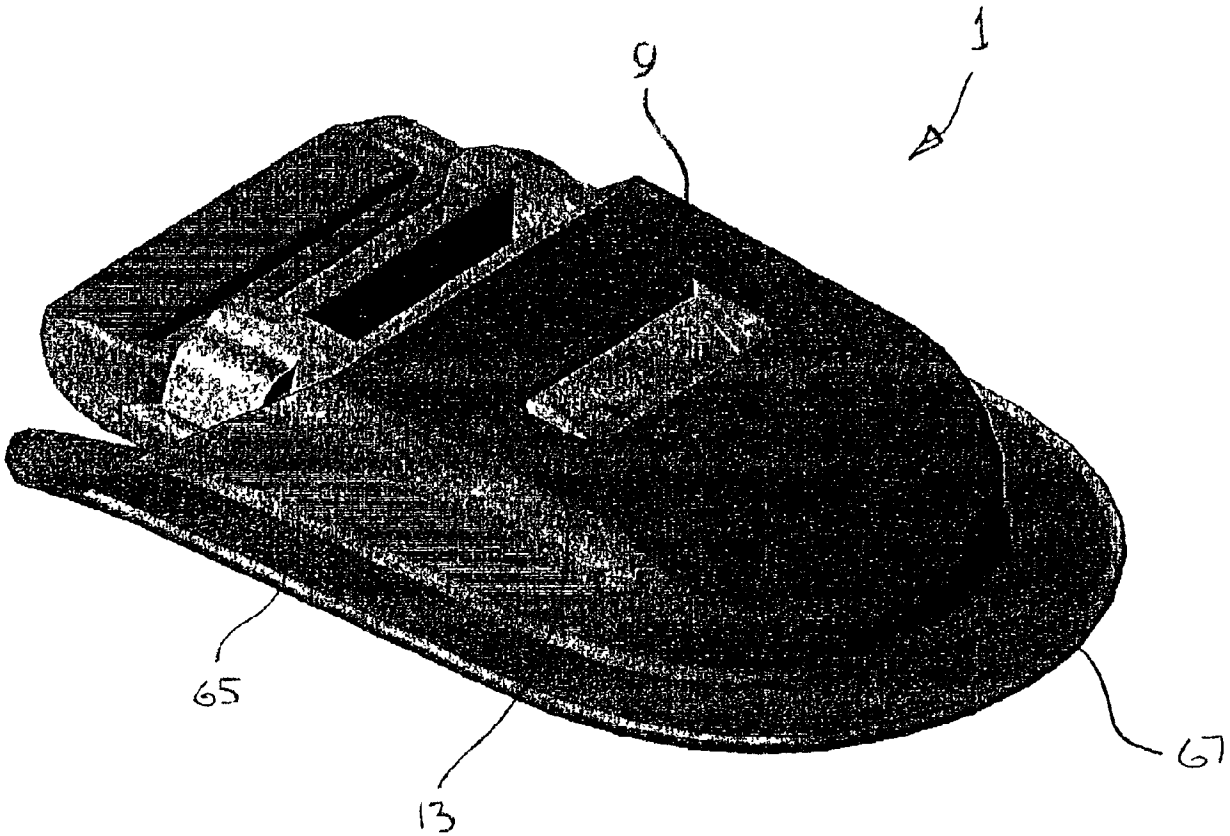
FIG. 3 is a top-perspective view of the same three pieces shown in FIGS. 1 and 2, except for the handle and handle strap, showing the fully assembled quick-release buckle.
Figure 1:
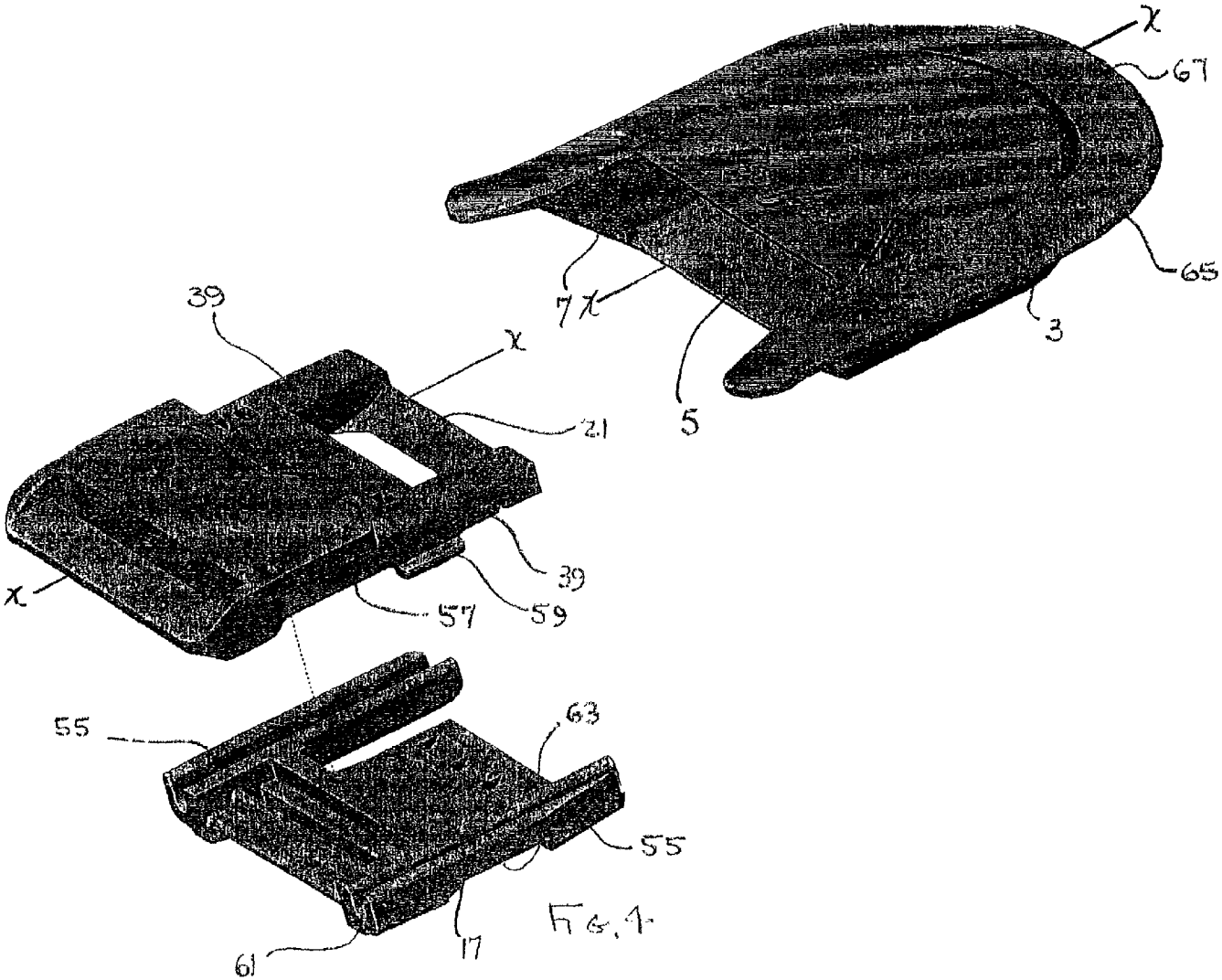
Figure 5:
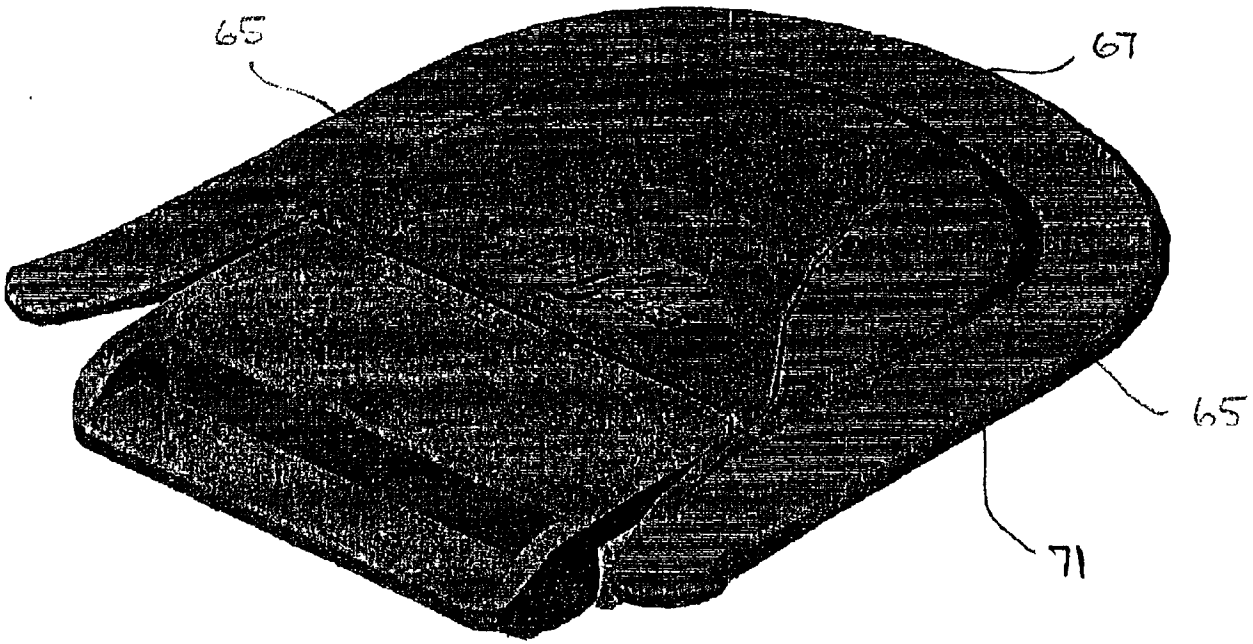
FIG. 5 is a bottom-perspective view of the same three pieces shown in FIG. 4 showing the fully assembled quick-release buckle.

Turning now to the drawings wherein elements are identified by numbers and like elements are identified by like numbers throughout the nine figures, the invention of a quick release buckle 1 is shown in totally disassembled form in FIG. 1*a*, in partially assembled but unbuckled form in FIG. 2, in buckled form in FIG. 3, in totally disassembled and upside down form in FIG. 4, and in fully assembled, upside down form in FIG. 5. The invention 1 is shown in these figures to comprise a female buckle member 3 having a pocket formed therein accessible through a rear opening 7 formed in female buckle member 3 and including a first cover 9 having an aperture 13 formed therein. Said aperture is preferably in the form of an elongated slot of a width generally longer than its depth; however, such an aperture may be modified to a plurality of different geometric openings and still lie within the scope of this invention. Aperture 13 is formed entirely through cover 9 so that it is accessible from outside cover 9 as well as from inside in pocket 5.

As shown in FIGS. 1*a* and 1*b*, a male buckle member 15 is provided, assembled with a handle member, about which more will be described later in this specification, said male buckle member 15 arranged for complimentary sliding assembly into female buckle member through rear opening 7. Male buckle member 15 includes a spring-like planar tongue or leaf spring 17 for insertion into pocket 5 of female buckle member 3. Leaf spring 17 passes along an axis x—x, aligned with pocket 5 and includes a first surface 19, an abruptly rising wall, having an abutment surface 21 formed thereon, extending upward from said first surface 19 to a second or lead-in surface 25 to form a clasp 27 whose surface continues along axis x—x and thereafter descends in a curve and preferably terminates at or near tongue surface 29. It is preferred that the abutment surface 21 on the abruptly rising wall be arranged to lie at an acute angle "α" with first surface 19 to insure that the engagement between the abutment surface 21 on the wall and aperture 13 is positive and not of the type that will allow surface 21 to slip out of locked engagement with aperture 13 except upon positively pulling them apart.

Tongue 17, clasp 27, as well as all other members and elements of this invention, are preferably made of plastic, and more preferably, fiber or filament reinforced plastic, such as graphite filament reinforced polyester resin. Such a material provides the required physical strength needed to endure handling of the buckle under strenuous underwater conditions, while at the same time being rather immune to the harsh environments of fresh water, pool water and especially sea water.

Tongue 17 is mounted on a frame cross-member 31 and is biased upward, i.e., in the direction of lead-in surface 25. During assembly of male buckle member 15, and its tongue 17, and the handle member, with female buckle member 3, tongue 17 is interconnected with female buckle member 3 in pocket 5, by sliding tongue 17 under first cover 9 while clasp 27, in its upwardly biased condition, enters into locking snap engagement with aperture 13.

A handle member 33 is provided for assembly with male buckle member 15 and the combination is inserted into pocket 5 in female buckle member 3. Handle member 33 is bound by a frame 37 that includes a pair of first side rails 39 held in spaced-apart arrangement by a base leg 41, from which a handle 43 extends, held thereto by a short length of strap 45 and held against withdrawal from pocket 5 by a front leg 49 on which is formed a release means 47. As shown in FIG. 1*c*, release means 47 is in the form of an angled release surface 51 that lies in tangential contact with lead-in surface 25 of clasp 27. Forward movement of release surface 51 allows clasp 27 to be released and buckle 1 to become unbuckled. Release means 47 may be in a form other than angled release surface 51. For example, as shown in FIG. 1*d*, means 47 may be in the form of a roller 53 laid tangent to lead-in surface 25. This geometry, namely having release surface 51 arranged in tangential contact with lead-in surface 25 of clasp 27, and arranged for a short, axial movement against second clasp surface 27 upon a quick pull of handle 43, provides the quick release feature of the invention. When handle 43 is so pulled, release surface 51 or release roller 53 moves clasp 27 out of engagement in aperture 13.

First side rails 39, in frame 37, are assemblable with a complimentary set of second side rails 55 formed in male buckle member 15 to control or eliminate side-to-side movement between male buckle member 15 and female buckle member 3, to control the movement therebetween in a forward and rearward direction along axis x—x, and to lock members 3 and in a single operative assembly. To facilitate this inter-sliding movement and allow easy assembly, first side rails 39, in handle member 33, provide an upstanding wall 57 with an upstanding and outwardly extending wing 59. Second side rails 55, in male buckle member 15, form an downwardly-opening U-shaped member 61 having a central opening 63 formed therein. During assembly of male buckle member 15 and handle member 33, U-shaped member 61 is placed over upstanding wall 57 and wing 59 and the two units pressed together so that U-shaped member 61 comes into sliding assembly over upstanding wall 57 and wing 59 slips or snaps through central opening 63 to form an inter-slidable assembly.

Figure 6:
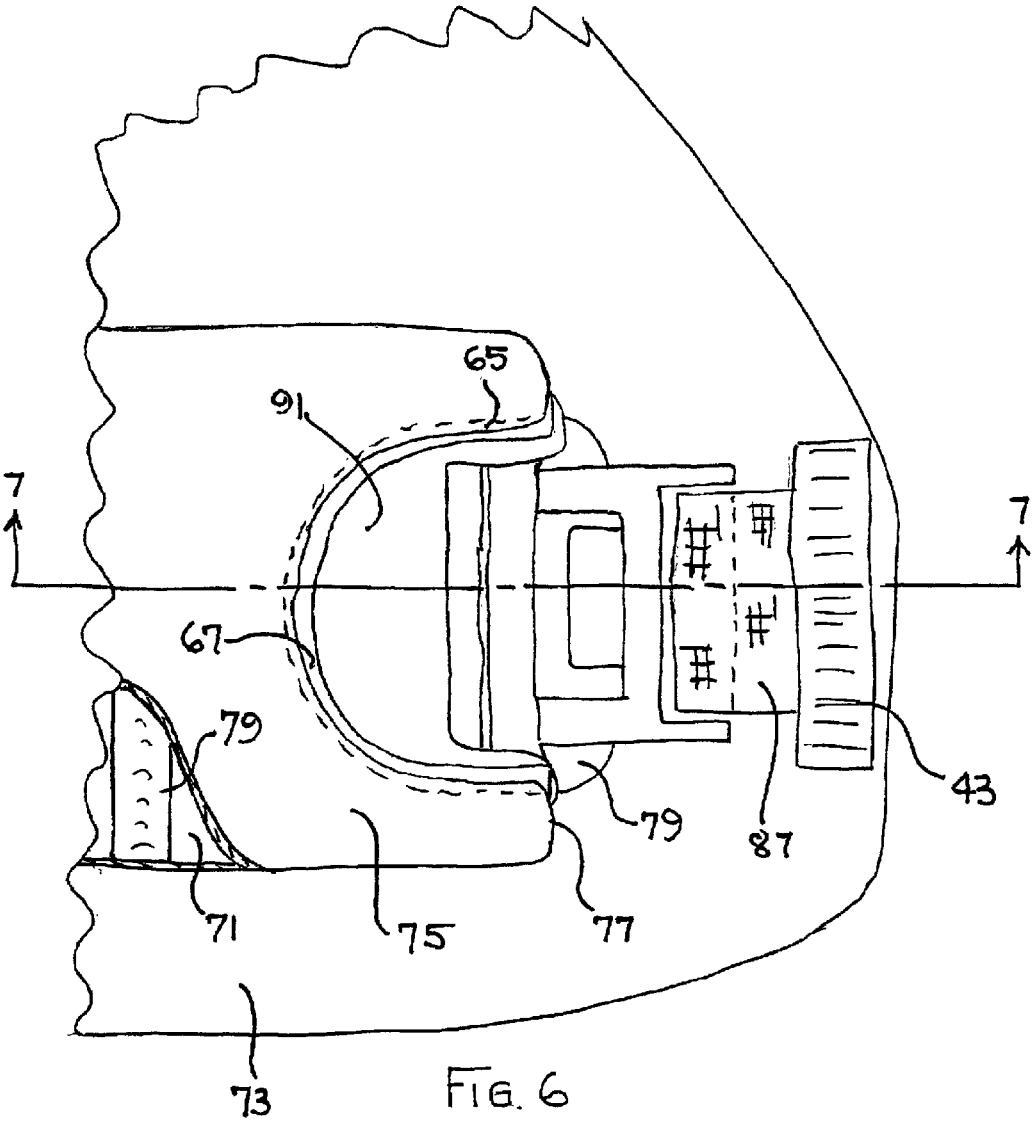
FIG. 6 is a front view of a typical buckle of this invention utilized in anchoring a weight flap into a pouch formed in a buoyancy vest; and, FIG. 7 is a sectional side view of the buckle shown in FIG. 6 taken along lines 7—7 in FIG. 6.
Figure 7:
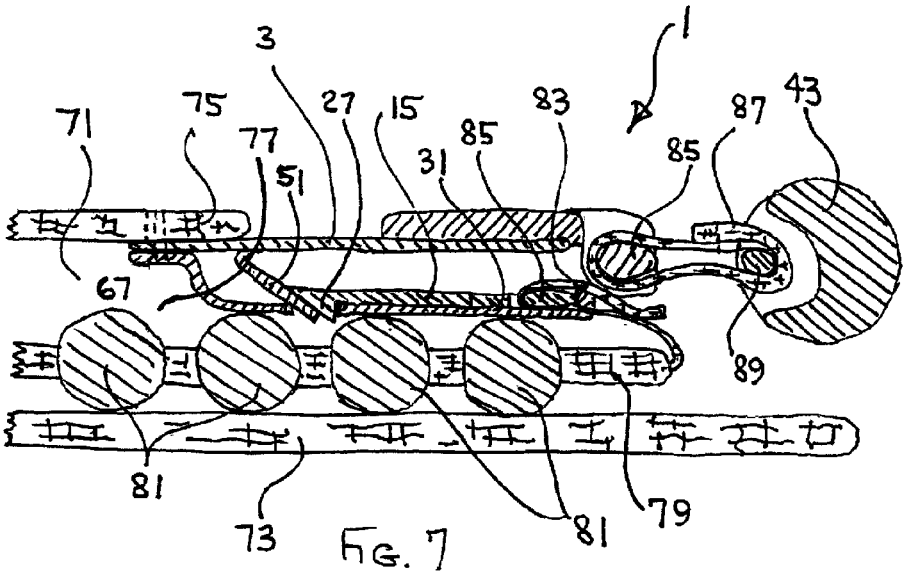

In the case of diving gear, as shown in FIGS. 6 and 7, a fabric pouch 71 is formed on the outside of a fabric buoyancy vest 73 using a fabric cover 75 having an open end 77. Female buckle member 3 is sewn or otherwise attached about its outside side edges 65 and outside front edge 67 to pouch open end 77 as shown in FIGS. 6 and 7. A fabric flap 79, arraying a plurality of weights 81, is temporarily housed in pouch 71. Flap 79 is attached to one end to male buckle member 15 by a short length of belt 83 that is sewn at one end to flap 79 and, at the other end, looped about and sewn back upon itself to form a connection to an attachment bar 85, spaced-apart from cross member 31. Buckle 1 is used to buckle weight flap 79 in pouch 71. Handle 43 is connected to male buckle member 15 by belt 45 attached between male buckle member 15 and cross-arm 89 on handle 43. During emergencies, when it is necessary to quickly separate the weights from the diver, a quick pull of handle 43 drives angled release surface 51, or roller 53, against clasp lead-in surface 25 to move clasp 27 away from aperture 13 and clear of its engagement therewith to separate weighted flap 79 and pull it clear of vest 73.

A second cover 91 is shown, provided in spaced-apart arrangement with first cover 9. Pocket 5 is formed between said covers and aperture 13 is formed in one of them. Usually, aperture 13 is provided in first cover 9.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A quick-release buckle comprising:

a) a spring-like, planar tongue, said tongue including a first surface, an abruptly rising wall arising out of said first surface to a second surface, that thereafter curves downward to a level to at least said first surface to form a clasp thereon;

b) a first cover adapted to receive said tongue thereunder, said first cover having formed therein an aperture and arranged to enter into sliding, biased contact with said tongue so that said clasp moves into registration with said aperture and is biased therein to be captured therein in locking engagement therewith; and, c) a handle member including a handle extending therefrom for assembly with said first cover having release means for contacting said clasp and moving said clasp against said bias and out of engagement with said aperture upon a single, quick pull of said handle.

d) a female buckle member attached to said first cover, said female buckle member comprising a pair of spaced-apart side walls and a front wall atttached to said first cover, for attachment to an item to be buckled, and a second cover spaced-apart from said first cover, said first cover and said second cover forming a pocket therebetween for acceptance therein of said tongue and said clasp; and, e) a male buckle member surrounding said spring-like, planar tongue and including a pair of spaced-apart side rails and a rear wall to which said tongue is anchored, wherein said rails are arranged for aligned assembly of said male buckle member with said female buckle member.

2. The quick-release buckle of claim 1 wherein said abruptly rising wall forms an acute angle with said tongue first surface to provide positive engagement with said aperture.

3. The quick-release buckle of claim 1 wherein said aperture in said first cover is a slot and said abruptly rising wall includes:

a) an abutment surface for locking engagement with a portion of said slot;

b) a curved lead-in surface on said clasp angling away from said abutment wall; and, c) wherein said release means is moved by said handle against said lead-in surface of said clasp to urge said clasp out of locking engagement with said slot.

4. The quick-release buckle of claim 1 wherein said female buckle member further includes an open rear end for inserting said tongue therein.

5. The quick-release buckle of claim 1 wherein said male buckle member and said handle member are combined into a single inter-attached element.

6. The quick-release buckle of claim 1 where/in said handle is attached to said handle member by a strap that is attached between said handle and said handle member.

7. A quick release buckle comprising:

a) a female buckle member having a pocket formed therein accessible through a rear opening formed in said female buckle member and including a first cover having an aperture formed therein;

b) a male buckle member arranged for complimentary sliding assembly into said female buckle member through said rear opening, including a spring-like planar tongue for insertion into said pocket of said female buckle member, said planar tongue including a first surface, a wall abruptly rising from said first surface, said wall having an abutment surface formed thereon extending upward from said first surface to a second surface to form a clasp that is adapted to enter into locking engagement with said aperture; and, c) a handle member, including a handle extending therefrom, for assembly with said male buckle member and the combination of said handle member and said male buckle member adapted for insertion into said pocket in said female buckle member, wherein said handle member includes release means for contacting said clasp and prying it out of locking engagement with said aperture, to part said male member and said female member, when said handle is sharply pulled.

8. The quick-release buckle of claim 7 further including rails formed on said male buckle member and on said female member to aid in aligned assembly of said male buckle member and said female buckle member.

9. The quick-release buckle of claim 7 further including:

a) a frame, surrounding said planar tongue, including a base leg and a pair of first spaced-apart side rails;

b) a pair of second spaced-apart side rails formed on said male buckle member for complimentary sliding assembly with said first pair of side rails to lock said rails in operative assembly; and, c) an upstanding wall with an outwardly extending wing formed on each of said rails of said first pair of spaced-apart side rails;

d) wherein said second side rails, on said male buckle member, forming an downwardly-opening U-shaped member having a central opening formed therein so that, during assembly of said male buckle member and said handle member, said U-shaped member may be placed over said upstanding wall and said wing and the two units pressed together so that when said U-shaped member comes into sliding assembly over said upstanding wall and said wing it slips or snaps through said central opening to form an inter-slidable assembly.

10. The quick-release buckle of claim 7 further including:

a) a first pair of rails arranged in spaced-apart position along the sides of said male buckle member; and, b) a second pair of rails arranged in spaced-apart position along the sides of said handle member to aid in aligned assembly of said male buckle member and said handle member.

11. The quick-release buckle of claim 7 wherein said clasp includes:

a) an abutment surface for locking engagement against a portion of said slot;

b) a lead-in surface curving away from said abutment portion; and, c) wherein said quick release means is moved by said handle against said lead-in surface of said clasp to urge said abutment portion out of locking abutment against said slot.

12. The quick-release buckle of claim 9 wherein said female buckle member further includes a second cover, in spaced-apart arrangement with said first cover, wherein said pocket is formed between said covers and said slot is formed in one of said covers.

13. The quick-release buckle of claim 7 wherein said female buckle member further includes spaced-apart side walls and a front wall to enclose said pocket and for attachment to an element to be buckled by said buckle.

14. The quick-release buckle of claim 7 wherein said male buckle member and said handle member further include complimentary side rails for confining movement therebetween to forward and rearward motion.

15. The quick-release buckle of claim 12 wherein said clasp is biased in a direction toward said slot formed in one of said covers and, when said male buckle member and said female buckle member are fully assembled, said clasp lies against said slot.

16. The quick-release buckle of claim 9 wherein said clasp includes a curved outer surface and said release means includes a flat surface in tangential contact with said clasp rounded outer surface, so that, during pulling motion of said handle portion, said flat surface urges said clasp inward said pocket and out of locking engagement in said slot.

17. The quick-release buckle of claim 9 wherein said clasp includes a curved outer surface and said release means includes a roller surface in tangential contact with said clasp rounded outer surface, so that, during pulling motion of said handle portion, said roller surface urges said clasp inward said pocket and out of locking engagement in said slot.

18. A buckle apparatus for rapid disengagement of members thereof, comprising:

a female member having an entry opening and at least one lateral opening, a male member having at least one deformable clasp portion adapted to extend into said end opening of the female member and to extend outwardly through said at least one lateral opening of the female member to retain the members together, wherein the male member comprises a cross-frame member carrying the at least one deformable clasp portion and a handle member having a release surface, the handle member slidably interengaged with the cross-frame; and an elongated pull element connected with the at least one male member clasp for manual pulling thereon to cause the release surface to contact the at least one male member clasp to disengage the male and female members from each other.

19. A buckle apparatus according to claim 18, wherein said female member has a generally flattened tubular configuration.

20. A buckle apparatus according to claim 18, wherein said at least one deformable clasp is a spring arm adapted to engage in the lateral opening of the female member to retain male and female members together.

21. A buckle apparatus according to claim 18, wherein the at least one male clasp extends only partially outwardly of said female member opening.

22. A buckle apparatus according to claim 18, wherein the elongated pull element is a web.

23. A quick-release buckle comprising:

a) a spring-like, planar tongue, said tongue including a first surface, an abruptly rising wall arising out of said first surface to a second surface, that thereafter curves downward to a level to a least said first surface to form a clasp thereon wherein said tongues passes along an axis x-x;

b) a first cover adapted to receive said tongue thereunder, said first cover having formed therein an aperture and arranged to enter into sliding, biased contact with said tongue so that said clasp moves into registration with said aperture and is biased therein to be captured therein in locking engagement therewith;

c) a handle member including a handle extending therefrom for assembly with said first cover having release means for contacting said clasp and moving said clasp against said bias and out of engagement with said aperture upon a single, quick pull of said handle; and d) a male buckle member surrounding said spring-like, planar tongue and including a pair of spaced-apart side rails and a rear wall to which said tongue is anchored, wherein said rails are arranged for aligned assembly of said male buckle member with said female buckle member.

24. A quick-release buckle comprising:

a) a spring-like, planar tongue, said tongue including a first surface an abruptly rising wall arising out of said first surface to a second surface, that thereafter curves downward to a level to a least said first surface to form a clasp thereon wherein said tongue passes along an axis x-x;

b) a first cover adapted to receive said tongue thereunder, said first cover having formed therein an aperture and arranged to enter into sliding, biased contact with said tongue so that said clasp moves into registration with said aperture and is biased therein to be captured therein in locking engagement therewith;

c) a handle member including a handle extending therefrom for assembly with said first cover having release means for contacting said clasp and moving said clasp against said bias and out of engagement with said aperture upon a single, quick pull of said handle;

d) a male buckle member surrounding said spring-like planar tongue and including a pair of spaced-apart side rails and a rear wall to which said tongue is anchored, wherein said rails are arranged for aligned assembly of said male buckle member and said handle member are combined into a single inter-attached element.

25. A quick-release buckle comprising:

a) a spring-like, planar tongue, said tongue including a first surface, an abruptly rising wall arising out of said first surface to a second surface, that thereafter curves downward to a level to at least said first surface to form a clasp thereon wherein said tongue passed along an axis x-x;

b) a first cover adapted to receive said tongue thereunder, said first cover having formed therein an aperture and arranged to enter into sliding, biased contact with said tongue so that said clasp moves into registration with said aperture and is biased therein to be captured therein in locking engagement therewith;

c) a handle member including a handle extending therefrom for assembly with said first cover having release means for contacting said clasp and moving said clasp against said bias and out of engagement with said aperture upon a single, quick pull of said handle;

d) a frame, surrounding said planar tongue, including a base leg and a pair of first spaced-apart side rails;

e) a pair of second spaced-apart side rails for complimentary sliding assembly with said first pair of side rails to control the movement therebetween in a forward and rearward direction and to lock said rails in a single operative assembly; and, f) an upstanding wall with an upstanding and outwardly extending wing formed on said pair of first space-apart side rails wherein said second side rails, in said male buckle member, form a downwardly-opening U-shaped member having a central opening therein so that, during assembly of said male buckle member and said handle member, said U-shaped member may be placed over said upstanding wall and said wing and the two units pressed together so that said U-shaped member comes into sliding assembly over said upstanding wall and said wing slips or snaps through said central opening to form an inter-slidable assembly.

* * * * *

UNITED STATES PATENT AND TRADEMARK OFFICE

CERTIFICATE OF CORRECTION

PATENT NO. : 7,073,234 B2
APPLICATION NO. : 10/077501
DATED : July 11, 2006
INVENTOR(S) : Turpin It is certified that error appears in the above-identified patent and that said Letters Patent is hereby corrected as shown below:

Col. 3, line 42: "member" should be--member 3--

Col. 4, line 44: "and" should be--and 15--

Col. 5, line 34: insert after "thereon"--wherein said tongue passes along an axis x-x;--

Col. 5, line 40: delete "and,"

Col. 5, line 45: "." should be--;--

Col. 7, line 57: "clasp" should be--protuberance--

Col. 7, line 63: "clasp" should be--protuberance--

Col. 7, line 67: "clasp" should be--protuberance--

Col. 8, line 2: insert after "member"--protuberance and deform and urge inwardly the male member protuberance--

Col. 8, line 8: "clasp" should be--protuberance--

Col. 8, line 12: "clasp" should be--protuberance--

Signed and Sealed this

Ninth Day of October, 2007

JON W. DUDAS
*Director of the United States Patent and Trademark Office*